US012781658B2

(12) United States Patent
Bauer

(10) Patent No.: US 12,781,658 B2
(45) Date of Patent: Nov. 3, 2026

(54) SECONDARY AIR VALVE FOR A SECONDARY AIR SYSTEM OF AN INTERNAL COMBUSTION ENGINE, INTERNAL COMBUSTION ENGINE AND MOTOR VEHICLE

(71) Applicant: Mercedes-Benz Group AG, Stuttgart (DE)

(72) Inventor: Mathias Bauer, Oehringen (DE)

(73) Assignee: Mercedes-Benz Group AG, Stuttgart (DE)

( * ) Notice: Subject to any disclaimer, the term of this patent is extended or adjusted under 35 U.S.C. 154(b) by 0 days.

(21) Appl. No.: 19/146,847

(22) PCT Filed: Nov. 24, 2023

(86) PCT No.: PCT/EP2023/082929
§ 371 (c)(1),
(2) Date: Jul. 9, 2025

(87) PCT Pub. No.: WO2024/153367
PCT Pub. Date: Jul. 25, 2024

(65) Prior Publication Data

US 2026/0218643 A1 Jul. 30, 2026

(30) Foreign Application Priority Data

Jan. 16, 2023 (DE) ..... 10 2023 000 108.2

(51) Int. Cl.
*F01N 3/30* (2006.01)
*F01N 3/05* (2006.01)
(Continued)

(52) U.S. Cl.
CPC ..... *F01N 3/30* (2013.01); *F01N 3/05* (2013.01); *F01N 3/22* (2013.01); *F01N 3/227* (2013.01); *F01N 3/34* (2013.01); *F01N 2550/14* (2013.01)

(58) Field of Classification Search
CPC ..... F01N 1/14; F01N 3/05; F01N 3/22; F01N 3/222; F01N 3/227; F01N 3/30;
(Continued)

(56) References Cited

U.S. PATENT DOCUMENTS 3,974,861 A * 8/1976 Goto ..... F01N 3/227 137/627.5
4,070,830 A * 1/1978 Beiswenger ..... F01N 3/22 60/306
(Continued)

FOREIGN PATENT DOCUMENTS

DE 103 57 886 B4 7/2015
GB 2520038 A 5/2015
(Continued)

OTHER PUBLICATIONS

International Search Report (PCT/ISA/210) issued in PCT Application No. PCT/EP2023/082929 dated Mar. 13, 2024 with English translation (5 pages).
(Continued)

*Primary Examiner* — Binh Q Tran
(74) *Attorney, Agent, or Firm* — Crowell & Moring LLP

(57) ABSTRACT

A secondary air valve for a secondary air system of an internal combustion engine has a valve housing through which secondary air introduced into an exhaust gas system of the internal combustion engine can flow. The valve housing has an inlet opening via which the secondary air can be introduced into the valve housing and an outlet opening via which the secondary air can be discharged, and has a
(Continued)

valve element which can be moved along a movement direction between a closed position closing the outlet opening and an open position releasing the outlet opening. The inlet opening is arranged along the movement direction between two sealing elements via which the valve element is sealed. The valve element is free from a surface running diagonally or perpendicularly to the movement direction along its entire extension running between the sealing elements at least in the closed position along the movement direction.

9 Claims, 2 Drawing Sheets

(51) Int. Cl.
*F01N 3/22* (2006.01)
*F01N 3/34* (2006.01)

(58) Field of Classification Search
CPC . F01N 3/32; F01N 3/34; F01N 13/087; F01N 2340/06; F01N 2550/14; F01N 2900/1804
See application file for complete search history.

(56) References Cited

U.S. PATENT DOCUMENTS 4,274,385 A * 6/1981 Yuzawa ..... F02M 26/57 123/568.27
4,342,194 A * 8/1982 Paddock ..... F01N 3/227 137/625.48
5,499,502 A * 3/1996 Haniu ..... F01N 3/227 60/308
2005/0204732 A1 9/2005 Kouzu et al.
2006/0219231 A1* 10/2006 Uchida ..... F01N 3/225 123/585
2008/0073605 A1* 3/2008 Ishigaki ..... F16K 15/16 251/12
2016/0115845 A1* 4/2016 Fujita ..... F16K 25/00 251/318

FOREIGN PATENT DOCUMENTS

JP 08158874 A 6/1996
JP 2005042604 A 2/2005
JP 2019-090385 A 6/2019

OTHER PUBLICATIONS

German-language Written Opinion (PCT/ISA/237) issued in PCT Application No. PCT/EP2023/082929 dated Mar. 13, 2024 with English translation (9 pages).
German-language Office Action issued in German Application No. 10 2023 000 108.2 dated Jul. 27, 2023 (8 pages).
Japanese Office Action issued in Japanese Application No. 2025540984 dated Aug. 25, 2026, with English Translation (8 pages).

* cited by examiner

SECONDARY AIR VALVE FOR A SECONDARY AIR SYSTEM OF AN INTERNAL COMBUSTION ENGINE, INTERNAL COMBUSTION ENGINE AND MOTOR VEHICLE

BACKGROUND AND SUMMARY OF THE INVENTION

The invention relates to a secondary air valve for a secondary air system of an internal combustion engine. The invention further relates to an internal combustion engine for a motor vehicle, having a secondary air system. Furthermore, the invention relates to a motor vehicle.

A valve for a secondary air supply system of an internal combustion engine is taken as known from DE 103 57 886 B4, by means of which secondary air that can be supplied to this valve can be introduced into an exhaust gas system of the internal combustion engine. Furthermore, US 2016/0 115 845 A1 discloses a secondary air valve. Furthermore, a discharge mechanism for compressed gas is known from GB 2 520 038 A. A valve for a secondary air supply system of an internal combustion engine is also taken as known from DE 103 57 886 B4.

The object of the present invention is to create a secondary air valve for a secondary air system of an internal combustion engine, an internal combustion engine and a motor vehicle, so that a particularly advantageous secondary air injection can be realized.

A first aspect of the invention relates to a secondary air valve for a secondary air system of an internal combustion engine, also referred to as a combustion engine and designed, for example, as a reciprocating engine, i.e., as a reciprocating piston engine, of a motor vehicle also simply referred to as a vehicle. This means that, in its completely produced state, the motor vehicle, preferably formed as a motor car, in particular as a passenger car, has the internal combustion engine and can be driven by means of the internal combustion engine. The internal combustion engine, in its completely produced state, has the secondary air system. Furthermore, in its completely produced state, the internal combustion engine has an exhaust gas system, which is also referred to as an exhaust tract, through which exhaust gas of the internal combustion engine can flow. The internal combustion engine also has at least one combustion chamber, in particular several combustion chambers, wherein combustion processes take place in the respective combustion chamber of the internal combustion engine in a fuelled operation of the internal combustion engine. In the respective combustion process, a fuel-air mixture is combusted, from which exhaust gas of the internal combustion engine results. The exhaust gas can flow out from the respective combustion chamber and can flow into the exhaust gas system and subsequently can flow through the exhaust gas system. Furthermore, the internal combustion engine has an intake system, which is also referred to as an intake tract. Air, which is also referred to as fresh air, can flow through the intake system. The air can be guided to and into the respective combustion chamber by means of the intake system, so that the fuel-air mixture can be formed from the air and a preferably liquid fuel. Secondary air can be in particular directly introduced into the exhaust gas system, bypassing the respective combustion chamber, i.e., bypassing the or all of the combustion chambers of the internal combustion engine, by means of the secondary air system, so that the secondary air does not flow through the respective combustion chamber, in particular through any of the combustion chambers, of the internal combustion engine on its way through the secondary air system and to and into the exhaust gas system, i.e., it bypasses the respective combustion chamber, in particular the or all of the combustion chambers, of the internal combustion engine.

For example, at least one exhaust gas aftertreatment component for aftertreatment of the exhaust gas is arranged in the exhaust gas system. The secondary air, in particular oxygen contained in the secondary air, is used, for example, in order to effectively and efficiently heat and/or keep warm the exhaust gas aftertreatment component. In this regard, the secondary air, in particular the oxygen contained in the secondary air, is used, for example, in order to oxidize, i.e., to combust, an uncombusted combustible, i.e., uncombusted hydrocarbons, in the exhaust gas system, in particular in the exhaust gas aftertreatment component. In particular, the combustible may be the fuel.

For example, the secondary air system has a secondary air duct through which secondary air can flow and which, for example, can be or is fluidically connected to the intake system at a connection point. Therefore, for example, at least part of the air flowing through the intake system can be diverted at the connection point from the intake system by means of the secondary air duct and can be introduced into the secondary air duct. The air diverted from the intake system and introduced into the secondary air duct can flow through the secondary air duct as the secondary air and is guided to the intake system by means of the secondary air duct and is introduced into the intake system, in particular bypassing the respective combustion chamber. Thus, a part of the air flowing through the intake system is used as the secondary air. In this case, for example, the secondary air valve is arranged in the secondary air duct. For example, a quantity of the secondary air flowing through the secondary air duct can be adjusted by means of the secondary air valve. In particular, it is conceivable that the secondary air duct can be selectively fluidically blocked or released by means of the secondary air valve. If the secondary air valve releases the secondary air duct, the secondary air can flow through the secondary air duct and subsequently can be guided into the exhaust gas system. If the secondary air valve blocks the secondary air duct, no secondary air or no air can flow through the secondary air duct from the intake system.

The secondary air valve has a valve housing, also simply referred to as a housing, through which the secondary air to be introduced into the exhaust gas system of the internal combustion engine can flow. The valve housing has a cylindrical housing chamber, which is directly delimited by an inner circumferential lateral surface of the valve housing. The valve housing has, in particular at least or exactly, one inlet opening, via which the secondary air can be introduced into the valve housing and into the housing chamber. In particular, it is conceivable that the inlet opening is or can be fluidically connected to the intake system, in particular at the connection point. In this case, for example, the inlet opening opens, in particular directly, into the housing chamber. Thus, for example, the housing chamber is fluidically connected to the intake system via the inlet opening. In particular, the valve element is arranged at least partially in the valve housing and thus at least partially in the housing chamber, at least in the closed position, in particular in the closed position and in the open position.

Furthermore, the valve housing has, in particular exactly or at least, one outlet opening, via which the secondary air, i.e., the air that is or can be received in the housing chamber also referred to as a receiving chamber, can be purged or discharged from the valve housing, i.e., from the housing chamber. The secondary air can be introduced into the exhaust gas system by discharging the secondary air from the valve housing and thus from the housing chamber via the outlet opening.

Furthermore, the secondary air valve has a valve element which can be moved, in particular translationally, along the movement direction relative to the valve housing between a closed position and at least one open position. In the closed position, the outlet opening is closed by means of the valve element, i.e., fluidically blocked, so that the secondary air or the air that is or can be received in the housing chamber cannot flow through the outlet opening and thus overall cannot flow out from the valve housing and thus the secondary air valve via the outlet opening. In the open position, the valve element releases the outlet opening, so that the secondary air or the air that is or can be received in the housing chamber can flow through the outlet opening in the open position of the valve element and thus overall can flow from the valve housing or from the secondary air valve via the outlet opening. Thus, for example, the secondary air duct is closed in the closed position by means of the valve element and thus by means of the secondary air valve. In the open position, for example, the secondary air duct is released. In other words, for example, the valve element and thus the secondary air valve release the secondary air duct in the open position. Thus, for example, the air diverted from the intake system at the connection point can flow through the secondary air valve and subsequently the secondary air duct, as the secondary air in the open position of the valve element, in particular in such a way that the secondary air, which originates from the intake system, can flow into the valve housing via the inlet opening and overall can flow out from the valve housing and thus from the secondary air valve via the outlet opening.

For example, in particular in or during operation of the internal combustion engine, wherein air flows through the intake system during operation, a pressure also referred to as a housing chamber pressure or housing pressure prevails in the housing chamber and/or the housing pressure acts via the inlet opening on the valve element located, for example, in the closed position, wherein the housing pressure is caused by air which is received in the housing chamber and/or is caused by air which is received in the secondary air duct, in particular in a first duct region of the secondary air duct, and acts on the valve element located, for example, in the closed position in particular via the inlet opening. The housing pressure, prevailing in the housing chamber and/or in the first duct region and in particular acting on the valve element located, for example, in the closed position, corresponds, for example because the housing chamber is fluidically connected to the intake system via the inlet opening, to a pressure prevailing in the intake system and also referred to as intake system pressure, which is caused, for example, by the air flowing through the intake system or is a pressure of the air flowing through the intake system. Particularly if the connection point is arranged downstream of a compressor arranged in the intake system, by means of which the air flowing through the intake system is compressed, the intake system and thus the housing pressure can be very high, in particular higher than an ambient pressure. In particular, the air flowing through the intake system and received in the housing chamber may be the air compressed by means of the compressor, which is also referred to as charged air. Then, the intake system pressure is also referred to as charge pressure, so that the housing pressure is the charged pressure or corresponds to the charge pressure.

Thus, for example, the first duct region of the secondary air duct can be or is fluidically connected to the intake system at the connection point, and, for example, the first duct region of the secondary air duct is or can be fluidically connected to the inlet opening. Thus, for example, the intake system pressure can act in particular as the housing pressure in the housing chamber via the first duct region and/or the intake system pressure can act on the valve element via the first duct region and the inlet opening. In other words, for example, both in the closed position as well as in the open position, at least part of the air flowing through the intake system can flow into the housing chamber as the secondary air via the first duct region and the inlet opening, and thus can affect the housing pressure in the housing chamber. In particular, the intake system pressure can act on the valve element in the closed position of the valve element via the first duct region and the inlet opening. A second duct region of the secondary air duct is or can be fluidically connected to the exhaust gas system, for example, in particular at an introduction point, and, for example, the second duct region is fluidically connected to the outlet opening. Therefore, for example, in the open position, secondary air can flow through the outlet opening and thus can flow into the second duct region via the outlet opening and subsequently flow through the second duct region and can be guided from the outlet opening to the introduction point by means of the second duct region and introduced into the intake system at the introduction point.

The closed position is also referred to as a first position or is a first position of the valve element. The open position is also referred to as a second position or is a second position of the valve element. In particular, it is provided that in the two positions, i.e., both in the closed position as well as in the open position, the inlet opening is open, i.e., released, so that, for example, both in the closed position as well as in the open position, the housing pressure can act in the housing chamber and thus in the valve housing, in particular on the valve element, wherein, for example, at least in the closed position, the housing pressure in the housing chamber and thus in the valve housing can correspond to the intake system pressure. In particular, therefore, in the closed position the intake system pressure can act, in particular directly, on the valve element via the inlet opening. Expressed in summary, at least in the closed position, the housing pressure acting in the housing chamber and/or the intake system pressure acting on the valve element via the inlet opening and in particular the first duct region can be very high and in particular higher than the ambient pressure, so that the housing pressure or the intake system pressure can be substantially greater than 1 bar. The introduction of the secondary air into the exhaust gas system is also referred to as a secondary air injection.

In order to be able to realize a particularly advantageous secondary air injection, it is provided according to the invention that the inlet opening is arranged as viewed along the movement direction, in particular completely, between two sealing elements, by means of which the valve element is sealed against the valve housing. In this case, the valve element is free from a surface running diagonally or perpendicularly to the movement direction at least on the outer circumference, in particular on the outer circumference and inner circumference and very preferably fundamentally, along its entire extension running along the movement direction between the sealing elements at least in the closed position, so that the intake system pressure and/or housing pressure acting for example at least in the closed direction on the outer circumference of the valve element does not cause a force acting in the movement direction on the valve element or a force, which has a force component running along the movement direction or in the movement direction. In other words, it can be avoided due to the invention that, in the closed position, the intake system pressure causes a force running parallel or diagonal to the movement direction and acting on the valve element, by means of which force the valve element could be opened, i.e., could be moved from the closed position into the open position. Therefore, the valve element can be securely held in the closed position, i.e., can be protected from undesired opening, i.e., from undesired movement from the closed position into the open position. Again, expressed in other words, due to the invention, undesired movements of the valve element, occurring relative to the valve housing and effected by the housing pressure or the intake system pressure, in particular from the closed position into the open position can be avoided, so that, for example, the valve element securely remains in the closed position and does not open independently in an undesirable manner. In particular, the invention enables the aforementioned connection point to be arranged in such a way that the connection point is arranged downstream of the compressor, so that the charge air as the secondary air, i.e., at least part of the charge air, can be used. Due to the invention, the high housing pressure or intake system pressure does not lead to undesired opening of the valve element, i.e., undesired movement from the closed position into the open position. Therefore, needs-based secondary air injection can be realized, and in particular at least part of the charge air can be used as the secondary air, so that the secondary air injection can be carried out, for example, in particularly advantageous operating regions or in particular also during a cold start of the internal combustion engine.

An outer circumferential lateral surface of the valve element, facing towards the inner circumferential lateral surface, is sealed against the inner circumferential lateral surface of the valve housing by means of the sealing elements. This means that, for example, the air originating from the intake system or the secondary air cannot excessively flow between the inner circumferential lateral surface and the outer circumferential lateral surface, so that undesired flows of the air and thus any undesired forces resulting therefrom and acting on the valve element, which could open the valve element, can be reliably avoided. In particular, the inner circumferential lateral surface is assigned to the outer circumferential lateral surface, in particular along a direction running perpendicular to the movement direction.

The valve element is designed as a plate-shaped or disc-shaped valve and has a plate-shaped or disc-shaped valve part and has a valve stem, to which the valve part is connected. Furthermore, the secondary air valve has a third sealing element, by means of which the valve part is sealed against the valve housing in the closed position.

The invention is based in particular on the following findings and considerations: Conventional secondary air systems only have a very small idling region. This means that conventional secondary air systems can only be used in a small idling operating region of the internal combustion engine in order to carry out a secondary air injection. However, in order to be able to carry out a secondary air injection during a cold start with higher loads, a high pressure of the secondary air, also referred to as secondary air pressure, is required, because then and in particular only then can the secondary air be injected into the exhaust gas system against an increasing pressure of the exhaust gas, also referred to as exhaust gas pressure. Therefore, it is an advantage to close the secondary air duct, in particular the first duct region, at the intake system and in particular at the connection point, i.e., to fluidically connect the secondary air duct to the intake system, in particular at the first duct region, at the connection point, wherein the connection point is preferably arranged downstream of the mentioned compressor. Therefore, at least part of the charge air compressed by means of the compressor can be used as secondary air, so that a particularly high secondary air pressure can be realized. In particular, then the secondary air pressure can correspond at least almost to the charge air. In particular, then the secondary air pressure can be greater than 2 bar. However, it has been found that conventional secondary air valves are not sealed at such high secondary air bridges, i.e., the secondary air duct cannot be held closed, but open in an undesired manner and in particular automatically at high secondary air pressures, which for example are greater than 500 mbar, and thus release the secondary air duct in an undesired manner, in particular without the conventional secondary air valves being controlled. This can now be avoided due to the invention, so that it is possible to close the secondary air duct at the intake system and in particular to use at least part of the charge air as the secondary air. It has also been found that conventional secondary air valves only remain sealed up to a pressure of approx. 500 mbar. At comparatively higher pressures, conventional secondary air valves open automatically and in an undesired manner, so that conventional secondary air valves are not suitable to use charge air as the secondary air, the pressure of which is greater than 500 mbar, in particular greater than 1 bar and more particularly greater than 2 bar. However, this can now be realized by the invention.

In order to be able to reliably avoid forces, which act on the valve element, result from the housing pressure or from the intake system pressure and could open the closed valve element, and thus to be able to hold the valve element securely in the closed position, it is provided in one embodiment of the invention that the valve element is designed to be cylindrical on the outer circumference along its entire extension running along the movement direction between the sealing elements at least in the closed position, i.e., it has the form of a right circular cylinder. This means that an outer circumferential cylindrical construction of the valve element is provided at least over the entire extension of the valve element, running at least in the closed position in the movement direction between the sealing elements, so that the intake system pressure or the housing pressure is then prevented from exerting an axial force, i.e., a force acting on the valve element along the movement direction or diagonal to the movement direction, which could open the valve element. Thus, the secondary air duct, in particular the first duct region, can be advantageously fluidically connected to the intake system at the connection point preferably arranged downstream of the compressor, and the valve element can be held securely and closed. For example, the secondary air valve comprises a spring element, designed in particular as a mechanical spring, by means of which, for example, the valve element is to be or is held in the closed position. The invention enables the valve element to be particularly advantageously held in the closed position, in particular by means of the spring element, even when the air originating from the intake system has a high pressure, such as the charge air, for example, and thus, for example, is charge air.

The respective sealing element is preferably formed from rubber, i.e., from an elastically deformable material. For example, on the one hand, the respective sealing element rests, in particular directly, on the inner circumferential lateral surface of the valve housing and, on the other hand, rests, in particular directly, on the outer circumferential lateral surface of the valve element.

The valve element and the valve housing are also referred to as components of the secondary air valve. For example, the respective sealing element is arranged in a corresponding respective cavity of one of the components, wherein the respective cavity can be designed, for example, as a groove, in particular as an annular groove. The respective sealing element is partially arranged in the respective cavity and, for example, protrudes out from the respective cavity, in particular along a direction running diagonally or perpendicularly to the movement direction, so that, for example, the respective sealing element rests, in particular directly, on the lateral surface of the respective other component. Preferably, one component is the valve housing, so that the other component is the valve element, for example. This means that particularly advantageous sealing can be realized, so that undesired flows of the air originating from the intake system and undesired movements of the valve element, occurring relative to the valve housing, can be reliably avoided.

In order to be able to seal the valve element particularly advantageously against the valve housing, it is provided in a further embodiment of the invention that the sealing elements are designed separately from each other and are spaced apart from each other along the movement direction.

A further embodiment is characterized in that the sealing elements are held on the valve housing so that the valve element can be moved along the movement direction relative to the valve housing and relative to the sealing elements between the closed position and the open position, in particular translationally and more particularly purely translationally. Therefore, undesired flows of the air and thus undesired forces acting on the valve element, which could open the valve element in an undesired manner, can be reliably avoided, so that a particularly needs-based secondary air injection can be achieved.

Lastly, it has proven to be particularly advantageous when the inlet opening has a passage direction along which the air flowing into or that has flowed into the valve housing via the inlet opening can flow through the inlet opening, wherein the passage direction runs diagonally or preferably perpendicularly to the movement direction. Therefore, undesired, excessive forces acting on the valve element, which could move the valve element along the movement direction relative to the valve housing, can be avoided, so that a particularly advantageous and needs-based secondary air injection can be represented.

A second aspect relates to an internal combustion engine—also referred to as combustion engine or combustion motor—for a motor vehicle, wherein the internal combustion engine has a secondary air system which comprises at least one secondary air valve according to the first aspect of the invention. Advantages and advantageous embodiments of the first aspect of the invention are to be regarded as advantages and advantageous embodiments of the second aspect of the invention and vice versa.

One embodiment of the second aspect of the invention is characterized in that the internal combustion engine has the aforementioned exhaust gas system and the aforementioned intake system through which fresh air can flow, by means of which the fresh air (air) flowing through the intake system can be introduced into the respective combustion chamber of the internal combustion engine. The secondary air system has the mentioned secondary air duct which is or can be fluidically connected to the intake system at the connection point arranged upstream of the combustion chamber. Thus, at least part of the fresh air flowing through the intake system can be diverted at the connection point at the intake system by means of the secondary air duct and can be introduced into the intake system as the secondary air, bypassing the respective combustion chamber. The secondary air duct also has the secondary air valve which is arranged in the secondary air duct. As a result, a particularly advantageous secondary air injection can be achieved.

A further embodiment of the second aspect of the invention is characterized in that the mentioned compressor for compressing the fresh air flowing through the intake system is arranged in the intake system, wherein the connection point is arranged downstream of the compressor. Therefore, a particularly high pressure of the secondary air can be realized in a particularly simple manner, wherein the invention enables the valve element to remain securely in the closed position.

A third aspect of the invention relates to a motor vehicle, also referred to as a vehicle, which has an internal combustion engine according to the second aspect of the invention and can be driven by means of the internal combustion engine. Advantages and advantageous embodiments of the first aspect and the second aspect of the invention are to be regarded as advantages and advantageous embodiments of the third aspect of the invention and vice versa.

Further advantages, features and details of the invention can be seen from the following description of a preferred exemplary embodiment and from the drawings. The features and combinations of features mentioned above in the description as well as the features and combinations of features mentioned below in the description of the figures and/or shown alone in the figures can be used not only in the combination indicated in each case, but also in other combinations or on their own, without leaving the scope of the invention.

DETAILED DESCRIPTION OF THE DRAWINGS

In the figures, identical or functionally identical elements are provided with the same reference signs.

Figure 1:
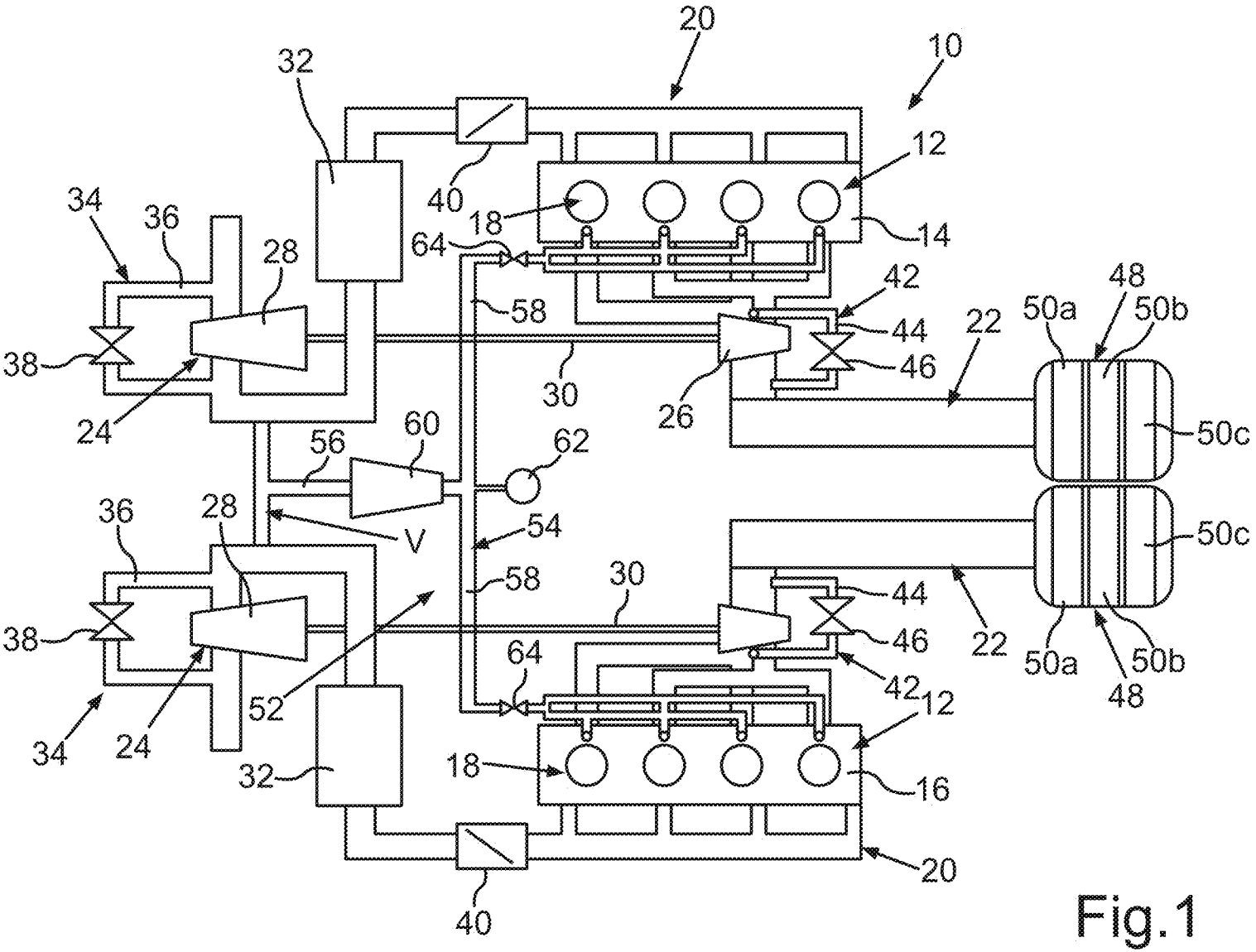
FIG. 1 is a schematic illustration of an internal combustion engine of a motor vehicle.

In a schematic illustration, FIG. 1 shows an internal combustion engine 10 of a motor vehicle, also simply referred to as a vehicle, which can be driven by means of the internal combustion engine 10. The internal combustion engine 10 has a cylinder housing 12 designed, for example, as a cylinder block and also referred to as an engine block, which in the present case has, for example, two cylinder banks 14 and 16 each having at least or exactly four cylinders 18. A respective combustion chamber of the internal combustion engine 10 is formed or delimited by the respective cylinders 18, so that the internal combustion engine 10 has exactly eight combustion chambers in the exemplary embodiment shown in FIG. 1. The internal combustion engine 10 has an intake system 20, through which air, which is also referred to as fresh air, can flow. The fresh air flowing through the intake system 20 is guided to and into the combustion chambers by means of the intake system 20. The internal combustion engine 10 also has an exhaust gas system 22 through which exhaust gas of the internal combustion engine 10, i.e., exhaust gas from the combustion chambers, can flow. An exhaust gas turbocharger 24, which has a respective turbine 26 arranged in exhaust gas system 22 and a respective compressor 28 arranged in the intake system 20, is provided for each cylinder bank 14, 16. The respective turbine 26 can be driven by the exhaust gas flowing through the exhaust gas system 22. The respective compressor 28 of the respective exhaust gas turbocharger 24 can be driven, in particular via a respective shaft 30 of the respective exhaust gas turbocharger 24, by the respective turbine 26 of the respective exhaust gas turbocharger 24. By driving the respective compressor 28, the fresh air flowing through the intake system 20 is compressed by means of the respective compressor 28. The fresh air compressed by means of the respective compressor 28 is also referred to as charge air. A respective charge air cooler 32 is arranged in the intake system 20 downstream of the respective compressor 28, by means of which charge air cooler the compressed and therefore heated charge air is cooled. A respective thrust air circulation system 34 having a respective thrust air circulation duct 36 and a respective thrust air circulation valve 38 arranged on the respective thrust air circulation duct 36 is provided for each compressor 28. Furthermore, a respective throttle valve 40 arranged upstream of the respective charge air cooler 32 is arranged in the intake system 20 for each cylinder bank 14, 16.

The respective turbine 26 is assigned a respective bypass device 42 having a respective bypass duct 44 and a respective bypass valve 46 arranged in the respective bypass duct 44. At least part of the exhaust gas flowing through the exhaust gas system 22 can bypass the respective turbine 26 via the respective bypass duct 44, wherein, for example, a quantity of the exhaust gas flowing through the respective bypass duct 44 and thus bypassing the respective turbine 26 can be adjusted by means of the respective bypass valve 46. The respective bypass valve 46 is also referred to as a wastegate or wastegate valve.

A respective exhaust gas aftertreatment device 48 is arranged downstream of the respective turbine 26 in the exhaust gas system 22. The respective exhaust gas aftertreatment device 48 comprises exhaust gas aftertreatment elements 50*a-c* by means of which the exhaust gas undergoes aftertreatment. For example, the exhaust gas aftertreatment element 50*a* is or comprises a catalyst, in particular a three-way catalyst. For example, the respective exhaust gas aftertreatment element 50*b* is or comprises a particulate filter. For example, the internal combustion engine 10 is designed as an Otto engine, so that the particulate filter is designed, for example, as an Otto particulate filter (OPF). For example, the respective exhaust gas aftertreatment element 50*c* is or comprises a respective, in particular further catalyst, in particular a three-way catalyst. The respective exhaust gas aftertreatment element 50*a-c* is also referred to as an exhaust gas aftertreatment component.

The internal combustion engine 10 furthermore has a secondary air system 52. The secondary air system 52 has a secondary air duct 54. The secondary air duct 54 has a first duct region 56, which is fluidically connected to the intake system 20 at a connection point V. It can be seen that the connection point V is arranged upstream of the combustion chambers and downstream of the compressor 28. The secondary air duct 54 has a second duct region 58 for each cylinder bank 14, 16. The duct region 56 is a duct region common to the duct regions 58. Secondary air can flow through the secondary air duct 54, wherein the secondary air initially flowing through the duct region 56 is distributed to the duct regions 58, i.e., is distributed to respective partial flows flowing through the duct regions 58. The secondary air flowing through the secondary air duct 54 is introduced into the exhaust gas system 22, in particular bypassing the or all of the combustion chambers, by means of the secondary air duct 54, and specifically at respective introduction points arranged downstream of the combustion chambers, at which the secondary air duct 54 is fluidically connected to the exhaust gas system 22. In particular, the respective second duct region 58 is fluidically connected to the exhaust gas system 22 at the respective introduction point. It can be seen from FIG. 1 that, for example, in particular at least or exactly one introduction point is provided for each combustion chamber, at which the secondary air duct 54, in particular the respective second duct region 58, is fluidically connected to the exhaust gas system 22.

The secondary air system 52 has a secondary air pump 60, also simply referred to as a pump, by means of which, for example, the secondary air can be conveyed through the secondary air duct 54. For example, the secondary air pump 60 is or functions as an auxiliary compressor, by means of which the secondary air is compressed or is to be compressed. For example, the secondary air pump 60 is an electric pump, i.e., an electrically operated pump, so that, for example, the secondary air pump 60 is designed as an electric auxiliary compressor.

As the connection point V is arranged upstream of the or all of the combustion chambers of the internal combustion engine 10 and downstream of the compressor 28, at least part of the charge air flowing through the intake system 20 can be diverted from the intake system 20 at the connection point V by means of the secondary air duct 54 and can be introduced into the exhaust gas system 22 as the secondary air, bypassing all combustion chambers of the internal combustion engine. As the secondary air pump 60 is arranged downstream of the connection point V, for example, the air already compressed by means of the compressor 28 and used as the secondary air is once again or further compressed, so that the secondary air flowing through the secondary air duct 54 is compressed air.

A pressure sensor 62 of the secondary air system 52 is arranged in the secondary air duct 54. A pressure of the secondary air can be detected by means of the pressure sensor 62, in particular downstream of the secondary air pump 60 and upstream of the introduction points.

A respective secondary air valve 64 of the secondary air system 52 is arranged in the respective second duct region 58, so that the respective secondary air valve 64 (SLV) is arranged in the secondary air duct 54. Thus, a respective secondary air valve 64 is provided for each cylinder bank 14, 16. It can be seen that the respective secondary air valve 64 is arranged upstream of the respective introduction point and downstream of the secondary air pump 60, in particular downstream of the pressure sensor 62.

Figure 2:
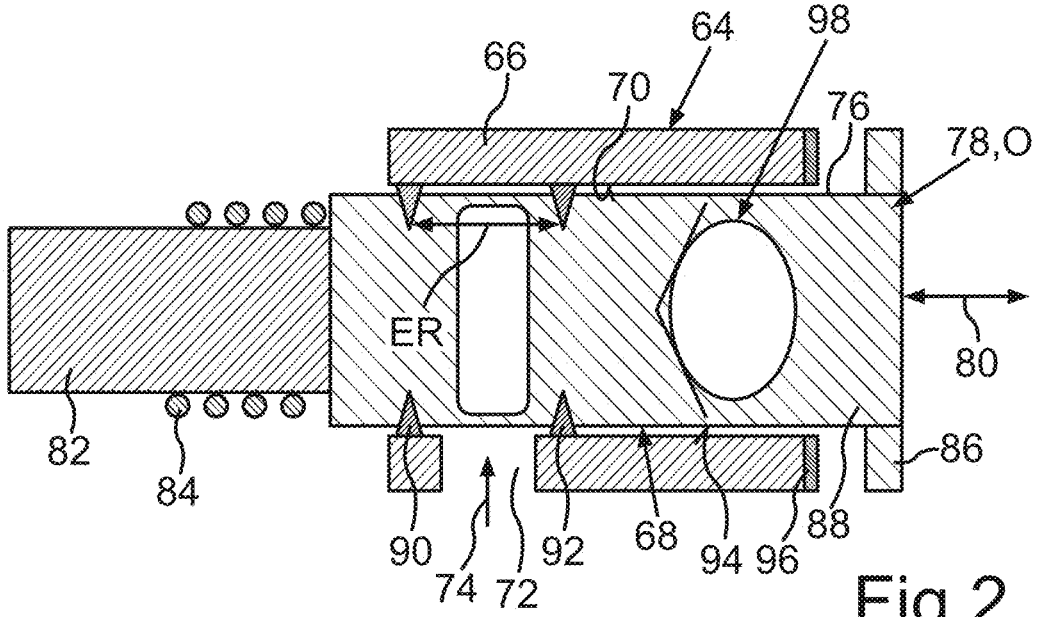
FIG. 2 is a schematic longitudinal section view of a secondary air valve of a secondary air system of the internal combustion engine, wherein a valve element of the secondary air valve is located in an open position.
Figure 3:
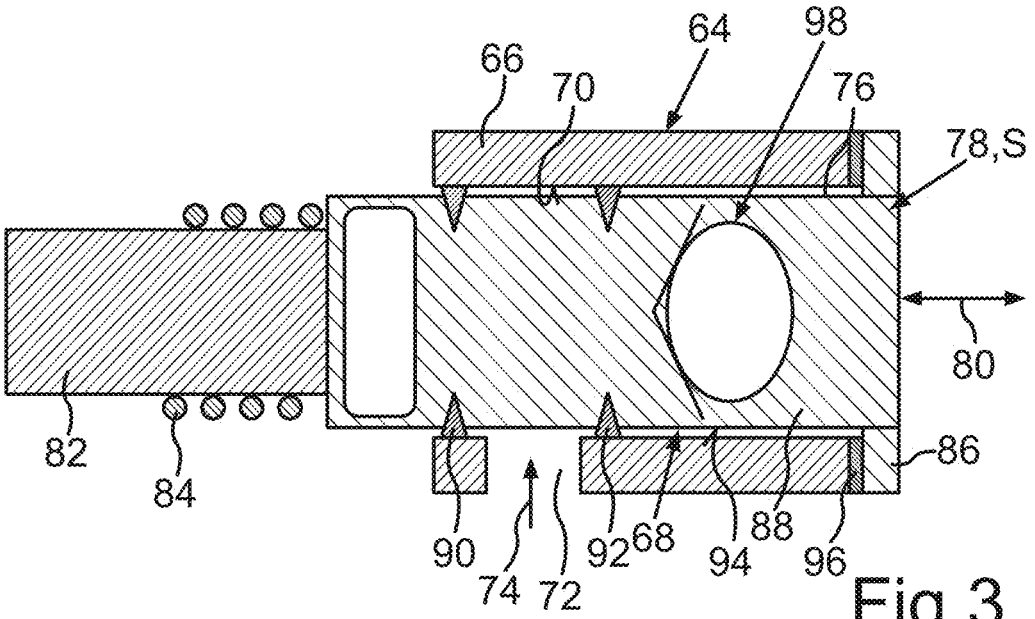
FIG. 3 is a schematic longitudinal section view of the secondary air valve, wherein the valve element is located in a closed position.

The respective secondary air valve 64 is shown in a respective schematic longitudinal section view in FIGS. 2 and 3. It can be seen from FIGS. 2 and 3 that the secondary air valve 64 has a valve housing 66, which has a housing chamber 68, also referred to as a receiving chamber or valve chamber, in particular delimited and more particularly directly delimited. The housing chamber 68 is directly delimited by an inner circumferential lateral surface 70 of the valve housing 66. The housing chamber 68 is cylindrical.

The secondary air flowing through the secondary air duct 54, in particular the respective second duct region 58, can flow through the valve housing 66, in particular the housing chamber 68, so that the secondary air flows through the secondary air duct 54 and thus through the valve housing 66, in particular through the housing chamber 68, on its way from the connection point V to the respective introduction point and thus to the exhaust gas system 22.

The valve housing 66 has, in particular exactly, one inlet opening 72, via which the secondary air can flow into the valve housing 66 and thus into the housing chamber 68, i.e., can be introduced. This is illustrated by an arrow 74 in FIG. 2. Furthermore, the valve housing 66 has, in particular exactly, one outlet opening 76, via which the secondary air that has flowed into the valve housing 66 and thus into the receiving chamber (housing chamber 68) via the inlet opening 72, can be purged or discharged, i.e., can flow out, as a whole from the valve housing 66, in particular from the secondary air valve 64.

Furthermore, the secondary air valve 64 has a valve element 78, which can be translationally moved between a closed position (S) closing the outlet opening 76 (FIG. 3) and at least one open position O releasing the outlet opening 76 (FIG. 2) along a movement direction, illustrated by a double arrows 80 in FIG. 2, relative to the valve housing 66. It can be seen that in the closed position S, the valve element 78 closes the outlet opening 76, also referred to as an outflow opening, i.e., fluidically blocks it. In the open position O, the valve element 78 releases the outlet opening 76. Furthermore, it can be seen from FIGS. 2 and 3 that both in the closed position S as well as in the open position O, which are also collectively referred to as positions, the inlet opening 72 is open, i.e., released, and thus air originating in particular from the intake system 20 can flow through the inlet opening. In other words, in both positions, the housing chamber 68 is fluidically connected to the intake system 20 via the inlet opening 72 that has been released, i.e., is open, in both positions, so that in the closed position S, air originating from the intake system 20 and, for example, compressed by means of the respective compressor 28 can flow through the inlet opening 72 and thus can flow into the housing chamber 68 via the inlet opening 72 or can act on the valve element 78. Thus, in the closed position S of the valve element 78, air is received, for example, at least in one part of the housing chamber 68 and thus at least in one part of the valve housing 66, which air originates from the intake system 20 and, in particular when the internal combustion engine 10 is operated, is charge air, i.e., a part of the charge air or a part of the air compressed by means of the compressor 28. In other words, in the closed position S of the valve element 78, air originating from the intake system 20 acts, which, in particular when the internal combustion engine 10 is operated, is charge air, i.e., a part of the charge air or a part of the air compressed by means of the compressor 28. Thus, the air received in the closed position S of the valve element 78 at least in the part of the housing chamber 68 and also referred to as housing air, or the air acting on the valve element 78 via the inlet opening 72 in the closed position S of the valve element 78 and originating from the intake system 20, has a high pressure, because, for example, the housing air or the air acting on the valve element 78 via the inlet opening 72 in the closed position of the valve element 78 is the charge air or a part of the charge air.

The secondary air valve 64 has an actuator 82, here designed as solenoids, which can be supplied with electric energy and therefore can be controlled electrically. In other words, the actuator 82 can be supplied with electrical energy, i.e., with electrical current, which is also referred to as supplying current to the actuator 82. Furthermore, the secondary air valve 64 has a spring element 84, which here is designed as a mechanical spring and thus as a solid body. For example, the spring element opening 84 is screw spring. The valve element 78 initially located in the closed position S can be moved into the open position O from the closed position S, i.e., be opened, by means of actuator 82 due to the actuator 82 being supplied with current, i.e., by supplying the actuator 82 with electrical energy. This means that the spring element 84 is tensioned, whereby the spring element 84 provides a spring force, by means of which the valve element 78 can be moved from the open position O into the closed position S, i.e., is to be closed. For example, if the current supply to the actuator 82 is ended, the valve element 78 is moved from the open position O into the closed position S by means of the spring force of the spring element 84. For example, the spring element 84 is tensioned in the closed position S, so that the spring element 84 also provides a spring force in the closed position S, by means of which the valve element 78 is held in the closed position S. Thus, the secondary air valve 64 is closed when the actuator 82 is not being supplied with current. The valve element 78 is opened counter to the spring force of the valve element 84 by means of the actuator 82 due to the actuator 82 being supplied with current.

The valve element 78 is designed as a plate-shaped or disc-shaped valve and therefore has a plate-shaped or disc-shaped valve part 86. Furthermore, the valve element 78 has a valve stem 88, to which the valve part 86 is connected. In this case, it is conceivable that the valve part 86 and the valve stem 88, which is also referred to as a rod or piston rod, are designed separately from each other and are connected to each other, or else that the valve part 86 and the valve stem 88 are designed as one piece together, i.e., are formed from a single piece. The valve stem 88 and the valve part 86, i.e., the valve element 78, can be moved translationally together from the closed position S into the open position O and from the open position O into the closed position S, along the movement direction relative to the valve housing 66. For example, the open position O and the closed position S are each end positions, wherein the valve element 78 can be moved into the respective end position, however not beyond the respective end position. In particular, the actuator 82 can drive the valve stem 88 and via this the valve part 86, and thus can move, i.e., open, relative to the valve housing 66. The spring force of the spring element 84 can also drive the valve stem 88 and via this the valve part 86 and thus close it.

As the inlet opening 72 is open in the closed position S, and thus as the housing chamber 68 is fluidically connected to the intake system 20 via the inlet opening 72 in the closed position S, the valve element 78 can be or is acted upon directly with the housing air, flowing into the valve housing 66 and thus into the housing chamber 68 via the inlet opening 72 and/or received in the valve housing 66, in particular via the valve stem 88 in the closed position S and/or the air originating from the intake system 20 acts on the valve stem 88 and thus on the valve element 78 via the inlet opening 72 in the closed position S.

In order to be able to avoid undesired opening of the secondary air valve 64 and subsequently to inject and realize a particularly advantageous secondary air, it is provided in the case of the secondary air valve 64 that the inlet opening 72 is arranged between two sealing elements 90 and 92, as viewed along the movement direction, by means of which an outer circumferential lateral surface 94 of the valve element 78, facing towards the inner circumferential lateral surface 70, is sealed against the inner circumferential lateral surface 70 of the valve housing 66. Therefore, it can be avoided, for example, that an excessive amount of the air acting on the valve element 78, in particular on the lateral surface 94, via the inlet opening 72 flows through between the lateral surfaces 70 and 94 beyond the sealing elements 90 and 92. Furthermore, it is provided that the valve element 78 is free from a surface running diagonally or perpendicularly to the movement direction on the outer circumference, i.e., on its outer circumferential lateral surface 94, along its entire extension ER running at least in the closed position S along the movement direction between the sealing elements 90 and 92. In other words, the outer circumferential lateral surface 94 of the valve element 78 does not have any surface over its entire extension E, running at least in the closed position S along the movement direction between the sealing elements 90 and 92, which surface extends in a plane which runs diagonally or perpendicularly to the movement direction (double arrow 80). Therefore, it can be prevented that the air acting directly on the valve element 78, in particular the lateral surface 94, via the inlet opening 72 in the closed position S and originating from the intake system 20 exerts a force acting on the valve element 78, which force has a force component running along the movement direction and thus could open the valve element 78. Thus, the valve element 78 can be held securely in the closed position S, in particular by means of the spring element 84.

In the exemplary embodiment shown in the figures, it is provided that the valve element 78 is designed to be cylindrical on the outer circumference, i.e., the lateral surface 94, along its entire extension ER, running at least in the closed position S along the movement direction between the sealing elements 90 and 92, and thus has the form of a right circular cylinder.

In the exemplary embodiment shown in the figures, the sealing elements 90 and 92 formed, for example, from rubber are designed separately from each other and then are spaced apart from each other along the movement direction, in particular completely. For example, the sealing elements 90 and 92 are held on the valve housing 66, so that the valve element 78 can be moved along the movement direction relative to the valve housing 66 and relative to the sealing elements 90 and 92 between the closed position S and the open position O.

The inlet opening 72 has a passage direction illustrated by the arrow 74, along which the housing air or the secondary air can flow or flows through the inlet opening 72. In this case, the passage direction runs perpendicular to the movement direction.

Furthermore, the secondary air valve 64 has a third sealing element 96, which, for example, can be designed separately from the valve housing 66 and separately from the valve element 78. Alternatively or additionally, the sealing element 96 is designed separately from the sealing element 90 and/or separately from the sealing element 92 and is spaced apart from the sealing element 90 and/or from the sealing element 92, in particular completely. The sealing element 96 can be formed from a rubber. In the closed position S, the sealing element 96 rests on the valve housing 66 and on the valve element 78, in particular on the valve part 86, in each case directly, so that in the closed position S, the valve element 78, in particular the valve part 86, is sealed against the valve housing 66 by means of the sealing element 96. Therefore, excessive leakages can be avoided.

Furthermore, it is preferably provided that the sealing element 90 and/or the sealing element 92 is designed separately from the valve element 78 and separately from the valve housing 66. On the one hand, the respective sealing element 90, 92 rests, in particular directly, on the valve housing 66, in particular on a lateral surface 70, and preferably, on the other hand, the respective sealing element 90, 92 rests, in particular directly, on the valve element 78, in particular on the valve stem 88 and more particularly on the lateral surface 94. As a result, a particularly advantageous sealing can be ensured.

Furthermore, the secondary air valve 64 has a check valve 98, which is arranged between the valve element 78, in particular the valve part 86, and the inlet opening 72, in particular as viewed along the movement direction.

The check valve 98 can be arranged further downstream in the flow direction of the outlet channel. Similarly, it does not necessarily have to be installed in the secondary air valve and could be accommodated in downstream components.

The invention claimed is:

1. A secondary air valve (64) for a secondary air system (52) of an internal combustion engine (10), comprising:

a valve housing (66) through which secondary air to be introduced into an exhaust gas system (22) of the internal combustion engine (10) is flowable, wherein the valve housing (66) has:

a cylindrical housing chamber (68) which is directly delimited by an inner circumferential lateral surface (70) of the valve housing (66);

an inlet opening (72) via which the secondary air is introducible into the valve housing (66) and into the cylindrical housing chamber (68); and an outlet opening (76) via which the secondary air is dischargable from the valve housing (66) for introduction of the secondary air into the exhaust gas system (22); and a valve element (78) which is movable along a movement direction (80) relative to the valve housing (66) between a closed position (S) closing the outlet opening (76) and at least one open position (O) releasing the outlet opening (76);

wherein the inlet opening (72) is disposed along the movement direction (80) between a first sealing element (90) and a second sealing element (92) via which an outer circumferential lateral surface (94) of the valve element (78) facing towards the inner circumferential lateral surface (70) is sealed against the inner circumferential lateral surface (70) of the valve housing (66);

wherein the valve element (78) is a plate-shaped or a disc-shaped valve and has a plate-shaped or disc-shaped valve part (86) and has a valve stem (88) to which the plate-shaped or disc-shaped valve part (86) is connected;

wherein the secondary air valve (64) has a third sealing element (96) via which the plate-shaped or disc-shaped valve part (86) is sealed against the valve housing (66) in the closed position (S);

wherein the valve element (78) is free from a surface running diagonally or perpendicularly to the movement direction (80) at least on an outer circumference along an entire extension (ER) running between the first sealing element (90) and the second sealing element (92) at least in the closed position (S) along the movement direction (80).

2. The secondary air valve (64) according to claim 1, wherein the valve element (78) is cylindrical on the outer circumference along the entire extension (ER).

3. The secondary air valve (64) according to claim 1, wherein the first sealing element (90) and the second sealing element (92) are separate elements from each other and are spaced apart from each other along the movement direction (80).

4. The secondary air valve (64) according to claim 1, wherein the first sealing element (90) and the second sealing element (92) are held on the valve housing (66) such that the valve element (78) is movable along the movement direction (80) relative to the valve housing (66) and relative to the first sealing element (90) and the second sealing element (92) between the closed position (S) and the at least one open position (O).

5. The secondary air valve (64) according to claim 1, wherein the inlet opening (72) has a passage direction (74) along which secondary air flowing into the valve housing (66) via the inlet opening (72) is flowable through the inlet opening (72) and wherein the passage direction (74) runs diagonally or perpendicularly to the movement direction (80).

6. An internal combustion engine (10) for a motor vehicle, comprising:

a secondary air system (52) which has the secondary air valve (64) according to claim 1.

7. The internal combustion engine (10) according to claim 6, further comprising:

the exhaust gas system (22); and an intake system (20) through which air is flowable, via which air flowing through the intake system (20) is introducible into at least one combustion chamber (18) of the internal combustion engine (10);

wherein the secondary air system (52) has:

a secondary air duct (54) which is fluidically connected to the intake system (20) at a connection point (V) disposed upstream of the at least one combustion chamber (18) such that at least part of the air flowing through the intake system (20) is divertable at the connection point (V) from the intake system (20) via the secondary air duct (54) and is introducible into the exhaust gas system (22) as the secondary air, bypassing the at least one combustion chamber (18);

wherein the secondary air valve (64) is disposed in the secondary air duct (54).

8. The internal combustion engine (10) according to claim 7, further comprising a compressor (28) disposed in the intake system (20) for compressing the air flowing through the intake system (20), wherein the connection point (V) is disposed downstream of the compressor (28).

9. A motor vehicle, comprising:

the internal combustion engine (10) according to claim 6.

* * * * *